US006743126B2

(12) United States Patent
Murphy et al.

(10) Patent No.: US 6,743,126 B2
(45) Date of Patent: Jun. 1, 2004

(54) STRAP FOR GRIPPING AN OBJECT

(76) Inventors: Brian Murphy, R.R.#1 STN MPP, Prince Albert, Saskatchewan (CA), S6V 5P8; Darcy Murphy, R.R.#1 STN MPP, Prince Albert, Saskatchewan (CA), S6V 5P8

( * ) Notice: Subject to any disclaimer, the term of this patent is extended or adjusted under 35 U.S.C. 154(b) by 0 days.

(21) Appl. No.: 10/369,698

(22) Filed: Feb. 21, 2003

(65) Prior Publication Data

US 2003/0171172 A1 Sep. 11, 2003

(30) Foreign Application Priority Data

Mar. 7, 2002 (CA) ..... 2375715

(51) Int. Cl.[7] ..... A63B 59/14
(52) U.S. Cl. ..... 473/563
(58) Field of Search ..... 473/560–563

(56) References Cited

U.S. PATENT DOCUMENTS 5,690,850 A 11/1997 Anderson
5,904,873 A 5/1999 Sadler et al.
5,943,767 A 8/1999 Milam
5,988,378 A * 11/1999 Bell, Jr. ..... 206/315.2
6,102,819 A 8/2000 Christian et al.
6,612,944 B1 * 9/2003 Bureau ..... 473/563

* cited by examiner

*Primary Examiner*—Mark S. Graham
(74) *Attorney, Agent, or Firm*—Ryan W. Dupuis; Adrian D. Battison; Michael R. Williams

(57) ABSTRACT

A method and apparatus is provided for removing a blade from a hockey stick. The strap includes first and second loops each having an anchored end connected to a respective slide aperture and a constricting end slidably received through the respective slide aperture for constricting the loop when pulled. The constricting end of the first loop is anchored to the second loop and the slide apertures are fixed relative to one another whereby pulling the constricting end of the second loop constricts the second loop thereby pulling on the constricting end of the first loop to simultaneously constrict the first loop. The method includes inserting the blade through the first and second loops respectively, heating the glue between the blade and the shaft and pulling the constricting end of the second loop away from the shaft so as to constrict the loops about the blade and pull the blade from the shaft.

6 Claims, 1 Drawing Sheet

STRAP FOR GRIPPING AN OBJECT

FIELD OF THE INVENTION

The present invention relates to a strap arranged for constricting about an object for gripping the object and more particularly to a method of removing a blade from a hockey stick by constricting the strap about the blade for gripping the blade.

BACKGROUND

Many commercially available hockey sticks include a replaceable blade in which the shaft of the hockey stick has a socket at one end thereof for slidably receiving the blade of the stick therein. The blade is typically snugly fit within the socket of the shaft and glued in place in order to be properly secured to the shaft. Removal and replacement of the blade thus requires heating the glue and pulling the blade from the shaft against considerable frictional forces due to the snug fit of the blade within the socket of the shaft.

Various devices have been proposed for assisting in gripping or replacing the blade of a hockey stick as demonstrated by the following U.S. Pat. No. 5,943,767 to Milam, U.S. Pat. No. 6,102,819 to Christian et al, U.S. Pat. No. 5,904,873 to Sadler et al and U.S. Pat. No. 5,690,850 to Anderson. None of these devices however are suitably arranged for portable use in various environments for gripping the blade of the hockey stick.

SUMMARY

According one aspect of the present invention there is provided a strap for constricting about an object, the strap comprising:

a first loop having an anchored end connected to a first slide aperture and a constricting end slidably extending through the first slide aperture for constricting the first loop when the constricting end of the first loop is pulled away from the first slide aperture;

a second loop having an anchored end connected to a second slide aperture and a constricting end slidably extending through the second slide aperture for constricting the second loop when the constricting end of the second loop is pulled away from the second slide aperture;

the first slide aperture and the second slide aperture being connected in fixed position relative to one another; and the constricting end of the first loop being anchored to the second loop whereby pulling the constricting end of the second loop constricts the second loop thereby pulling on the constricting end of the first loop to simultaneously constrict the first loop.

The use of two loops of material interconnected as described above, permits the strap to be constricted about an object much for securely than a simple noose for sufficiently gripping the object.

The first and second loops are preferably continuous with one another with the anchored end of the second loop being connected to the constricting end of the first loop and the first loop being connected between the anchored end of the second loop and the second slide aperture.

The first and second loops may be formed of a broad flat strip of woven nylon material. The resulting material is strong and flexible, while the broad flat shape evenly distributes the gripping force about the object.

An elongate looped handle may be connected to the constricting end of the second loop for ease of gripping.

According to a second aspect of the present invention there is provided a method of removing a blade slidably mounted and glued within a shaft of a hockey stick, said method comprising:

providing a strap comprising a first loop having an anchored end connected to a first slide aperture and a constricting end slidably extending through the first slide aperture for constricting the first loop when the constricting end of the first loop is pulled away from the first slide aperture; a second loop having an anchored end connected to a second slide aperture and a constricting end slidably extending through the second slide aperture for constricting the second loop when the constricting end of the second loop is pulled away from the second slide aperture; the first slide aperture and the second slide aperture being connected in fixed position relative to one another; the constricting end of the first loop being anchored to the second loop;

inserting the blade through the first and second loops respectively;

heating the glue between the blade and the shaft; and pulling the constricting end of the second loop away from the shaft so as to constrict the second loop about the blade thereby pulling on the constricting end of the first loop to simultaneously constrict the first loop about the blade.

The method preferably includes forming the first and second loops continuous with one another with the anchored end of the second loop being connected to the constricting end of the first loop and the first loop being connected between the anchored end of the second loop and the second slide aperture.

When there is provided an elongate looped handle connected to the constricting end of the second loop, the method preferably includes anchoring the elongate looped handle on a fixed supporting surface and pulling the shaft away from the fixed supporting surface.

BRIEF DESCRIPTION OF THE DRAWINGS

In the accompanying drawings, which illustrate an exemplary embodiment of the present invention.

DETAILED DESCRIPTION

Figure 2:
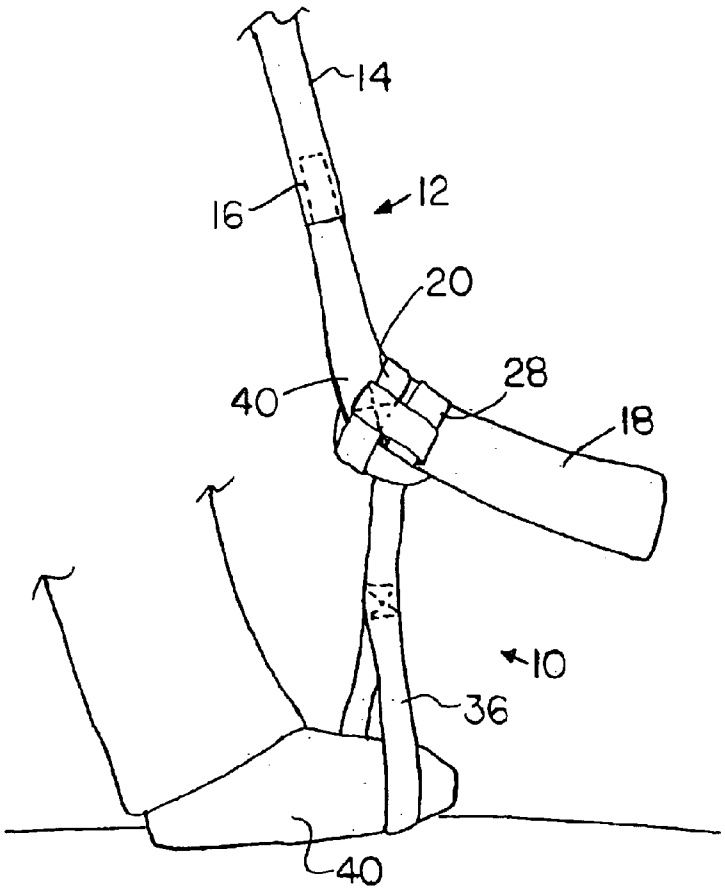
FIG. 2 is a perspective view of the strap shown constricted about a blade of a hockey stick.

Referring to the accompanying drawings, there is illustrated a strap generally indicated by reference numeral 10. The strap 10 is particularly useful for constricting about an object for gripping the object, for example a hockey stick 12 as shown in FIG. 2.

The hockey stick 12 generally comprises an elongate shaft 14 having a socket 16 formed at one end thereof for selectively receiving a conventional type replaceable hockey stick blade 18 therein. The blade 18 is snugly fit within the socket 16 and is further held in place by appropriate glue. The use of the strap 10 assists in gripping the blade 18 of the stick for removable of the blade from the shaft of the stick for replacement as desired.

Figure 1:
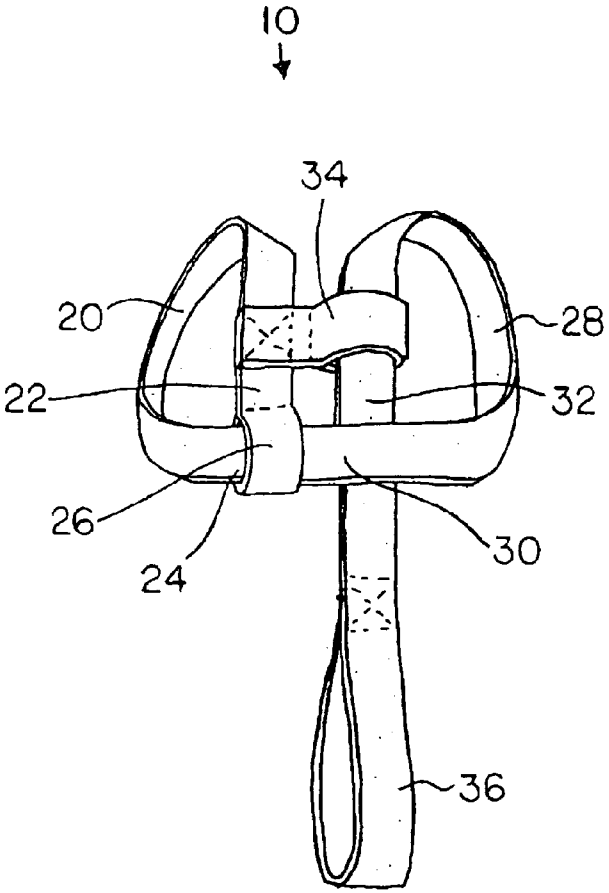
FIG. 1 is a perspective view of the strap.

The strap 10 generally comprises an elongate flat strip of broad woven nylon material which has been appropriately looped about itself and sewn in the desired configuration as illustrated in FIG. 1.

The strap 10 includes a first loop 20 having an anchored end 22 and a constricting end 24. A first slide aperture 26 is connected directly to the anchored end 22 of the first loop with the constricting end 24 passing through the first slide aperture 26 for sliding movement therethrough so that displacement of the constricting end 24 through and away from the first slide aperture 26 causes the first loop 20 to constrict.

The strap 10 further includes a second loop 28 having an anchored end 30 and a constricting end 32. A second slide aperture 34 is anchored to the first slide aperture 26 in fixed relationship therewith. The second slide aperture 34 receives the constricting end 32 of the second loop slidably extending therethrough for constricting the second loop when the constricting end 32 is extended through the second slide aperture 34 and pulled away therefrom. The anchored end 30 of the second loop is connected to the constricting end 24 of the first loop which is in turn connected to the first and second slide apertures for anchoring the anchored end 30 of the second loop to the second slide aperture 34.

By connecting the anchored end 30 of the second loop to the constricting end 24 of the first loop, the constricting end of the first loop is suitably anchored to the second loop so that constriction of the second loop pulls the constricting end 24 of the first loop to simultaneously constrict the first loop in use. The first and second loops are thus continuous with one another with the first loop being connected between the anchored end 30 of the second loop and the second slide aperture 34.

An elongate looped handle 36 is coupled to the constricting end 32 of the second loop to easily grip the constricting end for pulling the constricting end away from both the first and second slide apertures to simultaneously constrict both loops, as described above, about a desired object to be gripped.

As shown in FIG. 2, the first and second loops are suitable sized for receiving the blade of the hockey stick 12 therethrough. When removing the blade from the shaft of the hockey stick, the blade is inserted into the first and second loops of the strap 10 so that the loops are positioned adjacent a heel 40 of the blade. Heating and melting the glue which assists in securing the blade to the shaft permits the blade to be slidably removed from the shaft. The elongate looped handle 36 is then anchored against a suitable supporting surface such as the door handle on a door, or the foot 42 of a person as shown in the example of FIG. 2.

Pulling the shaft of the stick away from the supporting surface results in the elongate looped handle 36 pulling on the constricting end 32 of the second loop for constricting the second loop which in turn pulls on the constricting end 24 of the first loop due to the connection between the constricting end of the first loop and the anchored end 30 of the second loop. This pulling action on the constricting end 24 of the first loop thus simultaneously constricts the first loop about the blade of the hockey stick. By constricting the loops about the heel of the blade, a narrower portion of the blade is gripped by the loops for assisting in restricting removal of the loops from the blade as the blade is being removed from the shaft.

While one embodiment of the present invention has been described in the foregoing, it is to be understood that other embodiments are possible within the scope of the invention. The invention is to be considered limited solely by the scope of the appended claims.

What is claimed is:

1. A method of removing a blade slidably mounted and glued within a shaft of a hockey stick, said method comprising:

providing a strap comprising a first loop having an anchored end connected to a first slide aperture and a constricting end slidably extending through the first slide aperture for constricting the first loop when the constricting end of the first loop is pulled away from the first slide aperture; a second loop having an anchored end connected to a second slide aperture and a constricting end slidably extending through the second slide aperture for constricting the second loop when the constricting end of the second loop is pulled away from the second slide aperture; the first slide aperture and the second slide aperture being connected in fixed position relative to one another; the constricting end of the first loop being anchored to the second loop;

inserting the blade through the first and second loops respectively;

heating the glue between the blade and the shaft; and pulling the constricting end of the second loop away from the shaft so as to constrict the second loop about the blade thereby pulling on the constricting end of the first loop to simultaneously constrict the first loop about the blade.

2. The method according to claim 1 including forming the first and second loops continuous with one another with the anchored end of the second loop being connected to the constricting end of the first loop and the first loop being connected between the anchored end of the second loop and the second loop slide aperture.

3. The method according to claim 1 including forming the first and second loops of a broad flat strip of material.

4. The method according to claim 1 including forming the first and second loops of a woven nylon material.

5. The method according to claim 1 including providing an elongate looped handle connected to the constricting end of the second loop.

6. The method according to claim 5 including anchoring the elongate looped handle on a fixed supporting surface and pulling the shaft away from the fixed supporting surface.

* * * * *